United States Patent [19]

Hilgarth

[11] Patent Number: 5,031,340

[45] Date of Patent: Jul. 16, 1991

[54] SKI-BOOT

[75] Inventor: Kurt Hilgarth, Graz, Austria

[73] Assignee: Fischer Gesellschaft m.b.H., Reid im Innkreis, Austria

[21] Appl. No.: 503,922

[22] Filed: Apr. 4, 1990

[30] Foreign Application Priority Data

Apr. 11, 1989 [AT] Austria ..... 850/89

[51] Int. Cl.[5] ..... A43B 5/04

[52] U.S. Cl. ..... 36/117; 36/119; 36/120

[58] Field of Search ..... 36/117, 118, 119, 120, 36/121, 131

[56] References Cited

U.S. PATENT DOCUMENTS

| | | | |
|---|---|---|---|
| 3,807,060 | 4/1974 | Hanson et al. | 36/118 |
| 4,231,170 | 11/1980 | Griswold | 36/72 R |
| 4,470,206 | 9/1984 | Annovi | 36/121 |
| 4,677,769 | 7/1987 | Ahmad et al. | 36/120 X |
| 4,809,448 | 3/1989 | Tonel et al. | 36/120 |
| 4,922,635 | 5/1990 | Zanco | 36/120 |
| 4,928,407 | 5/1990 | Ottieri | 36/120 X |

FOREIGN PATENT DOCUMENTS

| | | | |
|---|---|---|---|
| 1066889 | 11/1979 | Canada | 36/118 |
| 0253306 | 1/1988 | European Pat. Off. . | |
| 2730550 | 1/1979 | Fed. Rep. of Germany | 36/121 |
| 3120955 | 3/1982 | Fed. Rep. of Germany . | |
| 3435738 | 5/1985 | Fed. Rep. of Germany . | |
| 3506056 | 3/1986 | Fed. Rep. of Germany . | |
| 2570936 | 4/1986 | France . | |
| 339771 | 11/1977 | German Democratic Rep. . | |

*Primary Examiner*—David T. Fidei
*Assistant Examiner*—BethAnne C. Cicconi
*Attorney, Agent, or Firm*—Fleit, Jacobson, Cohn, Price, Holman & Stern

[57] ABSTRACT

The shield of a ski-boot, which covers the instep region of the wearer's foot, is formed from a succession of individual elements which are overlapped in a fishscale-like manner so as to transmit pressure exerted by the wearer's leg or ski to the lowermost of the element which is fixed to the toe end of the boot undershell. The individual elements are guided on a central lenghtwise strap.

9 Claims, 6 Drawing Sheets

SKI-BOOT

BACKGROUND OF THE INVENTION

The invention relates to a ski-boot comprising a lower shell which is open essentially along its longitudinal centre line to the upper edge thereof at least in the bend and the instep region following thereon, and a cover means bridging the opening of the undershell.

In known ski-boots the front member which covers the bend and the instep is designed e.g. as a shield with folds, e.g. of the nature of a bellows, in order to facilitate bending down of the front portion in the forward inclined position of the skier or in the event of pressure of the foot against the front portion of the boot. This manner of constructing the front portion of the boot suffers from the disadvantage that when the boot is bent down in a forward direction, the fold regions press against one another and bulge laterally, whereby on the one hand the desired transmission of forces onto the undershell is unsatisfactory and on the other hand an unpleasant pressure is applied against the foot of the skier.

OBJECTS AND GENERAL DESCRIPTION OF THE INVENTION

An object of the invention is the provision of expedients by which this drawback is to be overcome, and steps are taken, whereby, when the skier leans forward, the pressure exercised by his leg onto the front region of the boot is diverted towards the toe end of the shell without a risk of lateral bulging of the latter.

This object is attained according to the invention in that the cover means bridging the central opening of the undershell takes the form of a shield composed of a succession of individual elements overlapping one another in a fish-scale-like manner, which deflect the pressure exercised thereon by the leg of the skier towards the toe end of the undershell, that the cover means bridging the opening on the heel side takes the form of a covering flap opening towards the rear, and that the central opening of the shell is at least partly closable by at least one cable member adapted to be tensioned, of which at least one part bridges the opening transversely to the longitudinal axis of the ski-boot below the shield.

Within the scope of the invention, the further subsidiary object is to be attained that the individual elements adapt to the movement of the leg of the skier. In order to attain this object a further feature of the invention provides that the individual elements are movable in relation to one another in the longitudinal direction of the boot at least on the instep side, being interconnected by a flexible cable core. In addition, it may be advantageous to secure the individual elements.

According to a further feature of the invention, the lowermost shield element is connected to the undershell.

According to a further feature of the invention, the lower shield element is connected to the undershell.

Furthermore, the invention provides that along at least one of the two opposite edges of two adjoining shield elements a strip, projections or the like is/are provided which in a fish scale-like manner engage(s) below the edge, strip or the like of the adjoining shield element.

According to a further feature of the invention, the shield elements are held on the boot by virtue of ropes, of which at least one end is fixed to the boot, respectively to the undershell or to the cover.

According to a further feature of the invention, compressable elements, e.g. strips, hoses or the like are provided between the shield elements.

BRIEF DESCRIPTION OF THE DRAWINGS

Further features of the invention will be further elucidated with reference to the drawing in which working examples of the ski-boot according to the invention are illustrated. There is shown in FIG. 1 a side elevation of a first embodiment of the ski-boot in question, FIG. 2 a perspective view of the undershell, including parts of the shield, FIG. 3, part of the shield elements in an exploded perspective view, FIG. 4 a second embodiment of the ski-boot in a perspective view, FIG. 5 a section along the line V—V of a modified embodiment of the ski-boot according to FIG. 4, FIG. 6, an embodiment of the heel portion of the ski-boot and FIGS. *7a* and *7b* embodiments of the closing means on the heel side.

DESCRIPTION OF SPECIFIC EMBODIMENTS

Figure 1:
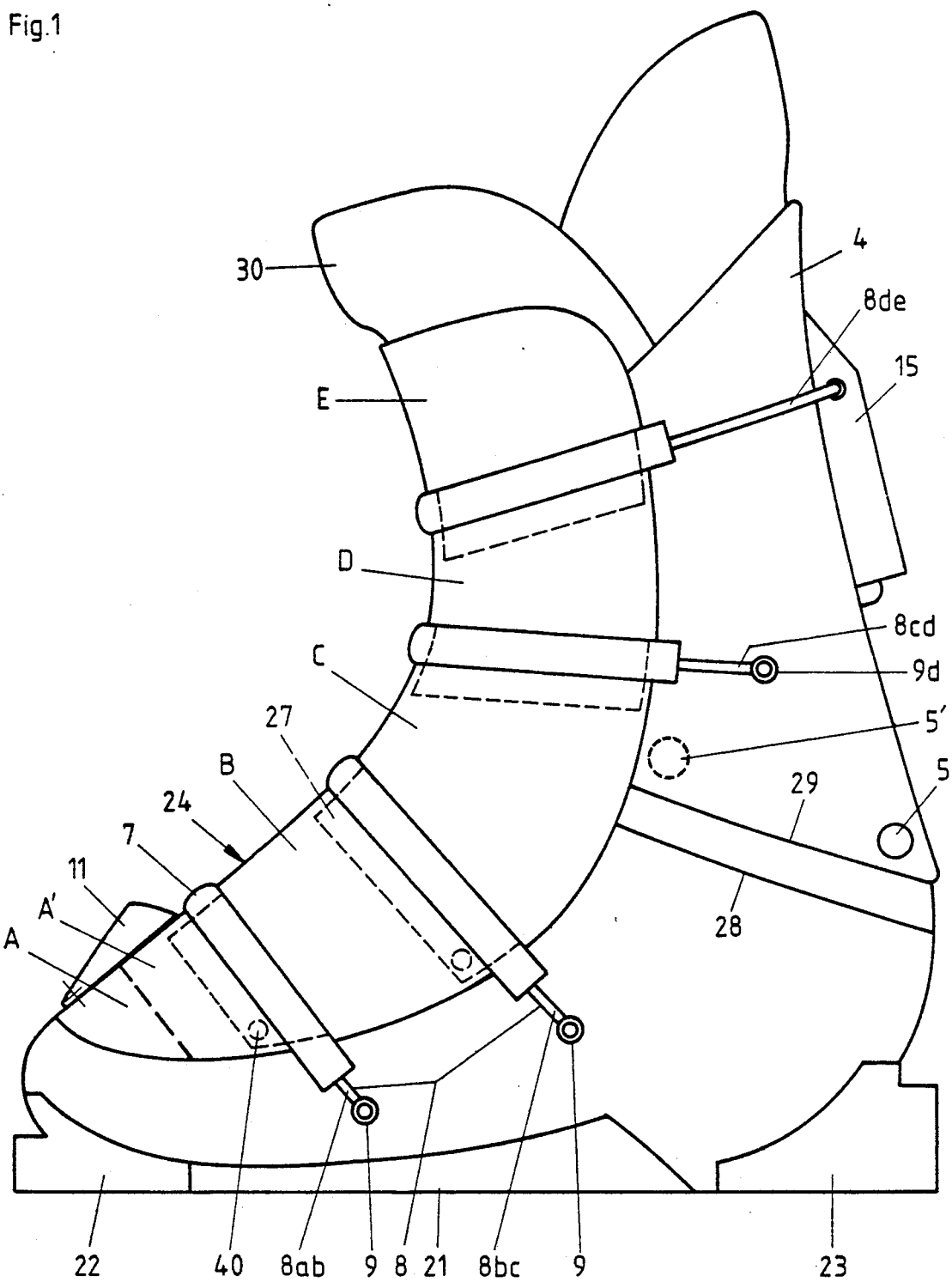
Figure 2:
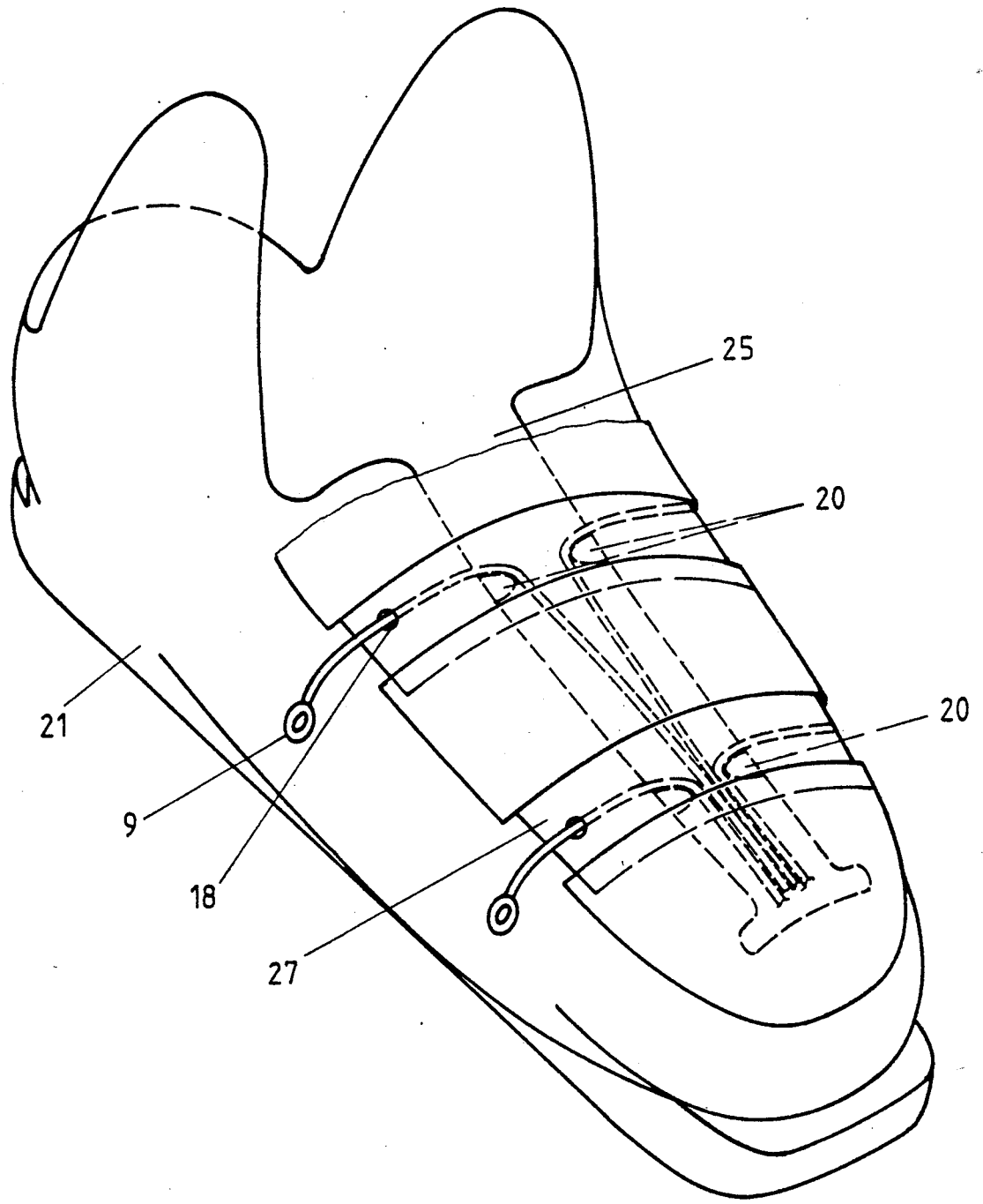
Figure 3:
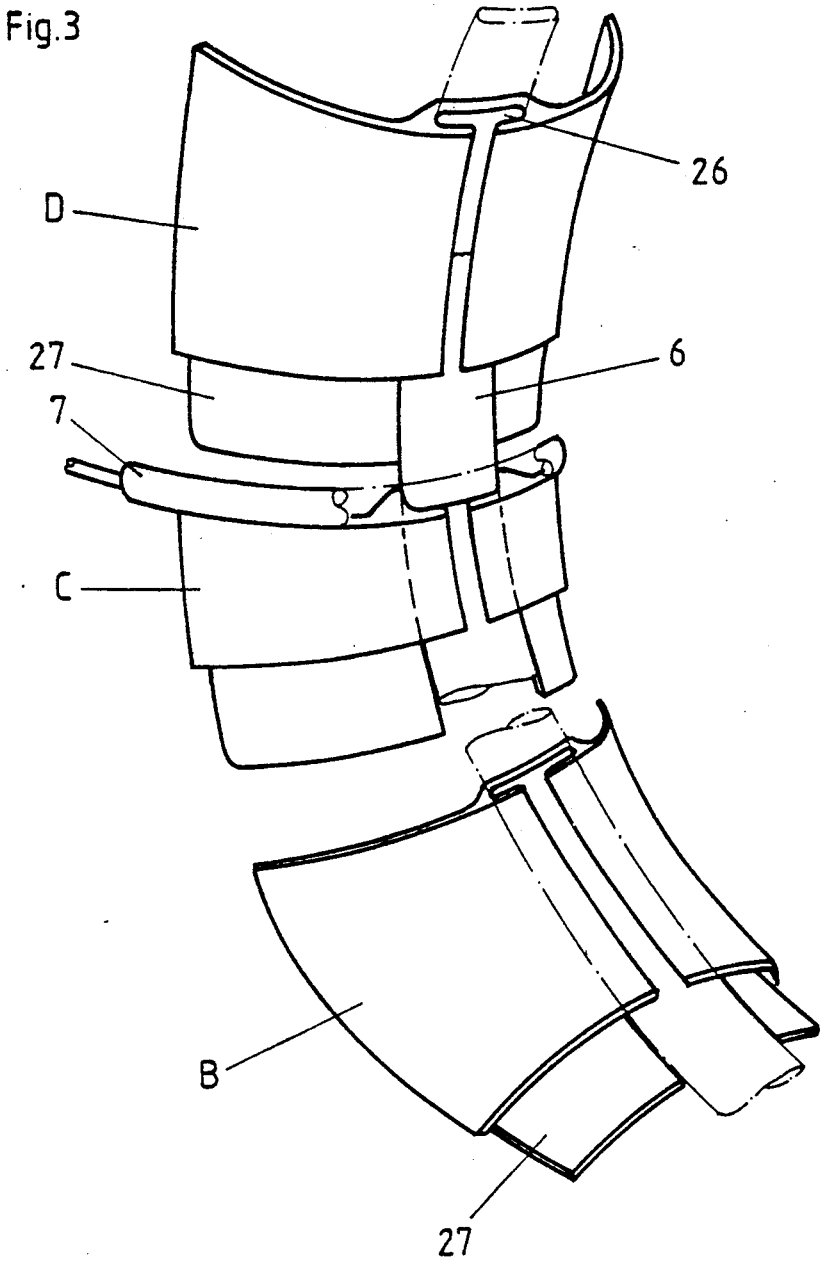

The ski-boot illustrated in FIG. 1 comprises an undershell 21 which preferably comprises a front and a rear member 22 and 23, respectively, both being interchangeable in order to fit the ski-boot to the particular ski binding used. The undershell 21 as shown in FIG. 2 is open in front in the bend and instep region and forms a slit 25 extending into the toe region which as illustrated is open or (as shown in broken lines in FIG. 5) may be covered by overlapping flaps 31, 32. The heel portion of the ski-boot forms a jet or cover 4 which on the heel side is hinged to the undershell 21 by a hinge means 5 or laterally by a hinge means 5'. In the event of the cover 4 being hinged to the undershell 21 by the hinge means 5' a closure means is provided as described in Austrian Patent Specification (A 2023/87). The front of the undershell is covered by a shield 24 composed of a succession of, in the present case five, shield elements A–E which as shown in FIG. 3 are essentially of U-shaped configuration and in their central region comprise a passage 26 which towards the outside is preferably open and which serves for accommodating a flexible member or strap 6 interconnecting the shield elements A–E and which is anchored in the terminal elements A and E and onto which the shield elements B–D have been threaded. Accordingly, this element 6 forms a kind of cable core for the shield elements and may for example be made of hard rubber. A compressable strip 7 is provided between the shield elements A–E which may be formed as strips, cushions, hoses or the like of elastic material, e.g. rubber or plastics and which may be interchangeable. They may be connected to at least one of the adjoining shield elements, e.g. by being plugged thereon.

The shield elements A–E each comprise a recessed ledge or tongue 27 which projects under the edge of the adjoining shield element, along one of its two edges facing an adjoining shield element. In the present case the elements B–E are provided with such a ledge along their lowermost edge. Accordingly, the shield elements A-E can slide together as an integral shield 24 when the foot applies pressure and accordingly exercise no unpleasant pressure on isolated regions of the foot. The shield 24 is fitted, e.g. hinged at its lowermost end by way of its first shield element A onto the undershell 21. Moreover, a marginal region A' of the shield element A adjoining the shield element B, or the entire shield element A may be composed of impact damping material, preferably resilient material, e.g. rubber such as hard rubber, which may for example merge with the flexible element 6. This serves to increase the comfortability of the ski-boot.

Instead of or in addition to the flexible element 6 the shield elements may be linked together at their adjoining, mutually overlapping corners, as indicated in FIG. 1 by the linkage 40, shown in FIG. 1 in broken lines.

Figure 7A:
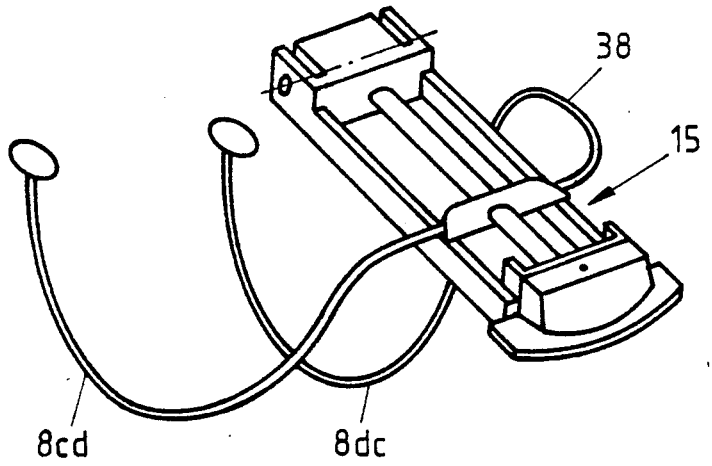
Figure 7B:
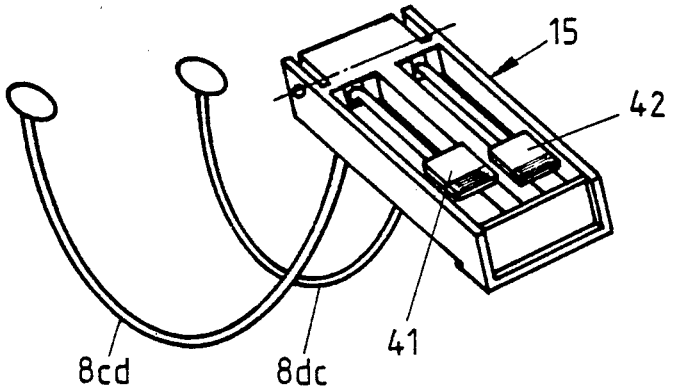
Figure 6:
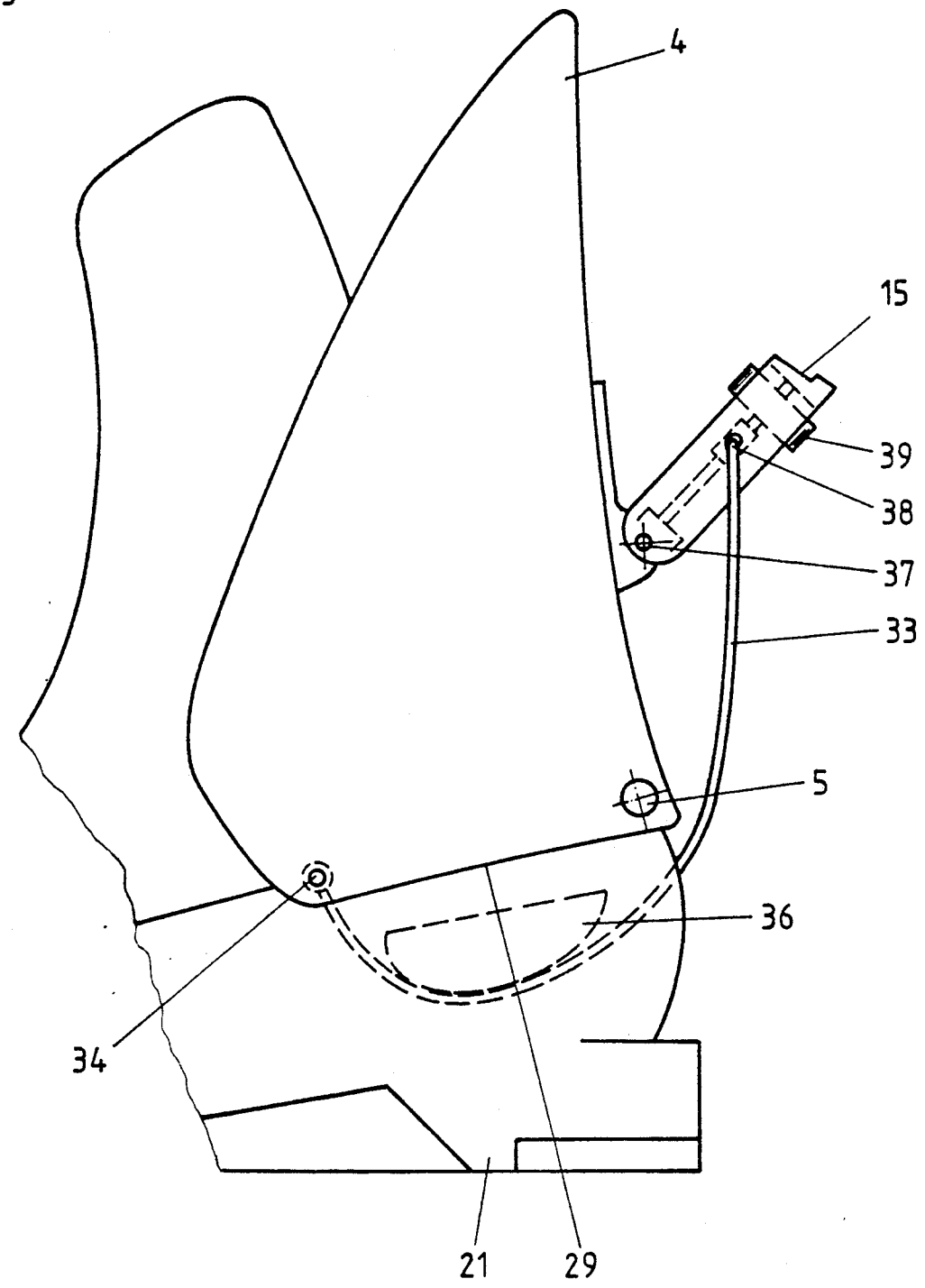

Cables 8*ab*–8*de* passing between the shield elements A–E serve for pressing the shield elements A14 E against the foot, respectively against the undershell. In the embodiment of the ski-boot according to FIG. 1, the cables 8*cd* and 8*de* which proceed the shield elements C and D, respectively are linked at one end to the cover 4, whereas the opposite end is hung into a closure means, e.g. a tensioning buckle 15 which, as shown in FIG. 6 may be pivotally connected at 37. In this context the lower cable 8*cd* is e.g. hinged to the left hand side of the cover 4 at 9*d* and the upper cable 8*de* is so hinged on the opposite side to the cover 4. The cables 8*cd* and 8*de* may, as shown in FIG. 7*a*, be interconnected on the heel side by a common loop 38 which is adapted to be hung onto a catch of the tensioning lever 35 such that by closing the tensioning lever 15 not only are the cable 8*cd* and 8*de* tensioned, but at the same time the cover 4 is closed which in this case is hinged at 5 to the undershell 21. In a different embodiment the two cables 8*cd* and 8*de*, as shown in FIG. 7*b* may be connected at their respective ends each to their own adjustable catch means 41, respectively 42, whereby it is made possible to tension the two cables 8*cd* and 8*de* differently in order thereby to attain a canting adjustment of the cover 4 and thereby also partly of the shield 24.

In the embodiment according to FIG. 6 the loop 38 of the uppermost cable is continued by a cable portion 33 which on the inside of the undershell 21 passes around a deflecting member 36 and in the region of the lower edge 29 of the cover 24 opposite to the pivoting locality 5 is fixed to the cover at 34, so that as mentioned further above the cover is closed as well by closing the tensioning buckle 15.

Cable pairs 8*ab*, respectively 8*bc* are passed between the shield elements A and B and between the shield elements B and C, one of these cables being linked at 9 on the one side of the undershell 21 and the other cable being so linked on the other side thereof. As shown in FIG. 2, each of the cables is passed on the strip 27 up to a hole 18 and from there under the strip 27 to the middle of the shield element, where the cable is deflected by way of a deflecting lug 20 towards the toe end where it is held by a tensioning element 11 and can be tensioned. The aforementioned compressable element, respectively the strip 7 in the form of a hose can be threaded onto these cables in the region of the strip 27.

In conclusion an inner shoe 30 should be mentioned which as described above is inserted into the ski-boot.

Due to the overlapping fish-scale-like design of the shield 24, a pressure thereon due to forward leaning of the skier is transmitted onto the lowermost element A, respectively to the undershell 21 so that a considerably reduced force is needed for steering the ski, as compared with what is necessary with conventional ski boots because the whole boot is not deformed but merely the foremost part thereof. Due to the adaptation of the shield to the anatomical shape of the foot, unpleasant localised pressure onto the foot is avoided. Also the ankle linkage which was needed with former boot collars is dispensed with. Depending on whether a forward or rearward pressure is applied to the boot, the flexible element, respectively the cable core 6 is subjected to decreasing or increasing tension.

In order to limit the pivoting movement of the cover 4 a means is provided as described in the aforementioned Austrian Patent Specification (A202/87) for hinging the cover to the undershell at 5'. When hinging the cover to the undershell at 5', the undershell 21 is provided with a heel member 28 against which the cover 4 can abut by means of its lower edge 29 when the cover 4 moves forward.

Figure 4:
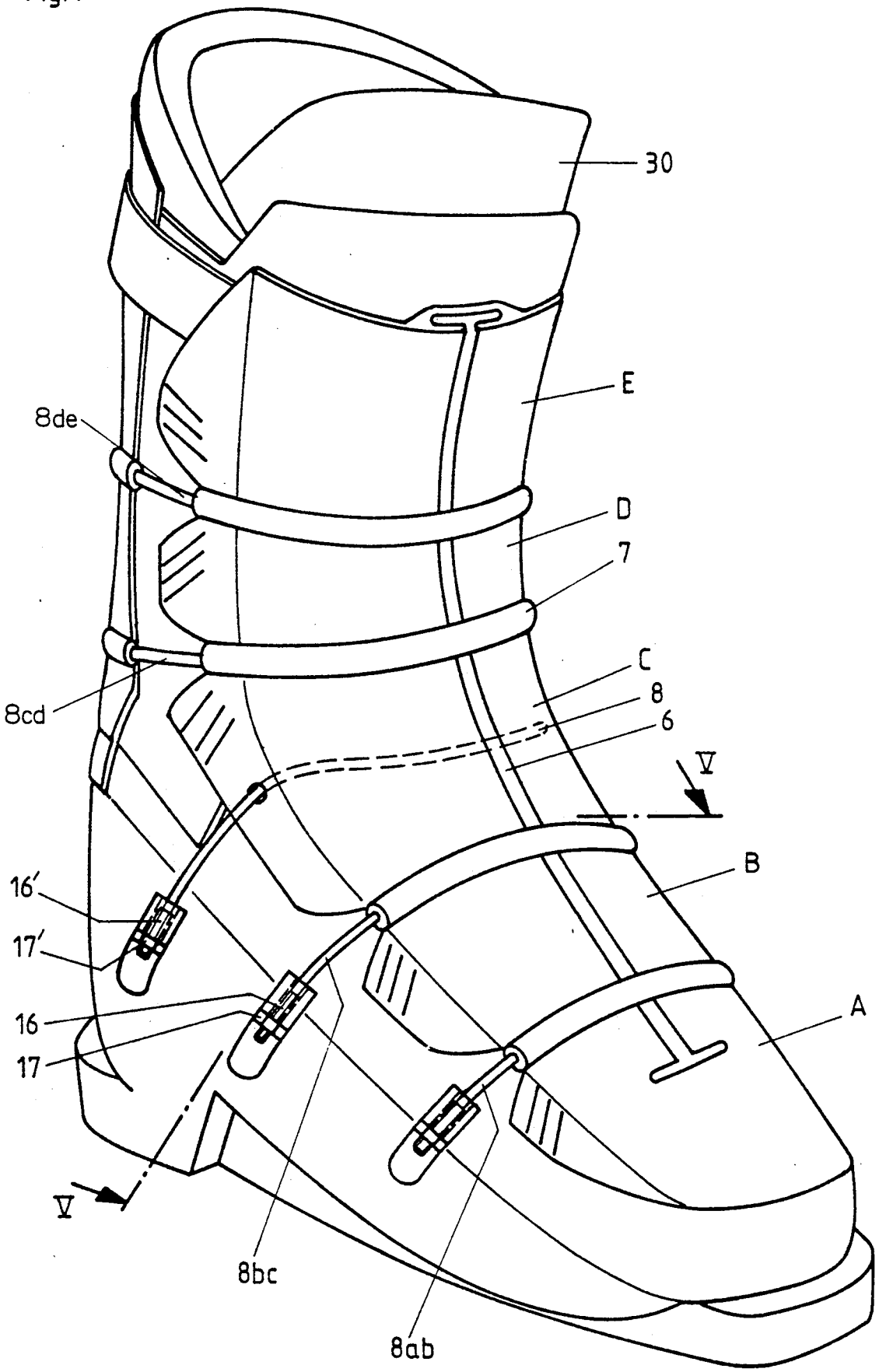

In the embodiment of the ski-boot according to FIG. 4, a single cable 8*ab*, respectively 8*bc* is provided instead of a pair of cables between the shield elements (A and B and the shield elements B and C and is connected at both ends to the undershell 21. In this context the connection of at least one of the two ends may proceed by way of a tensioning buckle. Preferably one end of the cable 8*ab*, respectively 8*bc* is connected to a threaded bolt 16 which is longitudinally adjustable from outside by a nut 17, thereby to change the tension of the cable 8*ab*, respectively 8*bc*.

Figure 5:
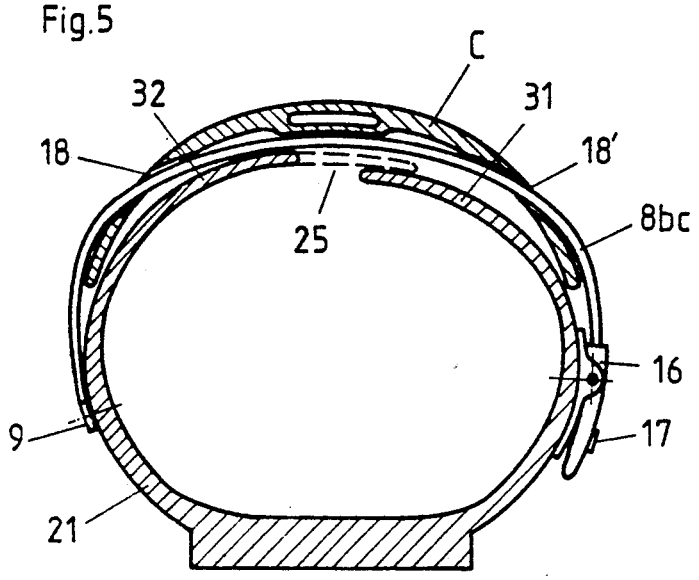

Within the scope of the invention various constructional modifications may be carried out. For example it is possible to select optionally the number, design and guidance of the cables. Thus the cable 8*bc* as shown in FIG. 5 where the cable is denoted as 8*bc'* may first be passed over the shield element T whereafter it passes through the holes 18, 18' below the shield element and passes between the latter and the flaps 32, 31 of the undershell 21. This design offers the advantage that tensioning of the cable 8*bc'* brings about a pressing against the inner shoe, both of the flaps 31, 32 as well as the shield element, in the present case the sheet element C. However, as shown in FIG. 2, the cable bc may also be passed via a deflecting member 20 forward to a tensioning means.

As further shown in FIG. 4, it is possible to provide an additional cable 8' which in the bend region, in the present case above or below the shield element C embraces the foot and is held in the heel region by a tensioning means 16', 17'. This results in fixing of the heel, i.e. a pulling backwards of the shield elements against the heel. For that purpose the tensioning means 16', 17' might be provided as previously mentioned, either on one side or on both sides. The cable 8' passes in the bend region inside the boot and presses onto the overlapping region of the undershell similarly as in FIG. 5.

What I claim is:

1. A ski-boot comprising an undershell having an instep portion with a central longitudinal opening, a jet hinged to the undershell for covering a heel region of a wearer's foot, a shield covering the undershell at least over said instep portion, the shield comprising a plurality of individual elements overlapped lengthwise in a fishscale-like manner for transmitting pressure exerted by a skier's leg on an uppermost one of said elements to a lowermost one of said elements, said lowermost one of said elements being attached to a toe portion of the undershell, and tensionable cable means attached on at least one of the undershell and the jet for closing the opening, the cable means at least partially bridging the opening.

2. A ski-boot as claimed in claim 1 including step down tongues on forward ends of respective ones of said elements, said tongues extending under rearward ends of adjacent elements.

3. A ski-boot as claimed in claim 1 including a lengthwise central strap extending upwardly from the lowermost one of said elements, and guide means on other ones of said elements embracing said strap.

4. A ski-boot as claimed in claim 1 wherein the lowermost one of said elements is hinged to the undershell.

5. A ski-boot as claimed in claim 1 wherein at least an uppermost portion of the lowermost one of said elements is formed of a shock-absorbing material.

6. A ski-boot as claimed in claim 1 which includes transversely extending compressible strips between adjacent ones of said elements and wherein the cable means includes cable portions covered by said strips.

7. A ski-boot as claimed in claim 1 wherein the cable means includes at least one cable extending over the shield and anchored to the jet by means of a tensioning buckle for tightening the jet relative to the shield.

8. A ski-boot as claimed in claim 1 wherein the cable means includes at least one pair of cables comprising a left and right cable, each cable having an upper end attached to the undershell on a respective side of the opening, the cable passing through one of said elements, over a deflecting member, and lengthwise down the opening to a fixture on the lowermost one of said elements.

9. A ski-boot as claimed in claim 8 wherein the fixture is a tensioning element.

* * * * *